US011542050B2

(12) United States Patent
Li

(10) Patent No.: US 11,542,050 B2
(45) Date of Patent: Jan. 3, 2023

(54) VACUUM SEALING MACHINE DRIVEN BY AIR PRESSURE

(71) Applicant: Qincan Li, Guangdong Province (CN)

(72) Inventor: Qincan Li, Guangdong Province (CN)

(73) Assignee: Bonsen Electronics Limited, Guangdong Province (CN)

( * ) Notice: Subject to any disclaimer, the term of this patent is extended or adjusted under 35 U.S.C. 154(b) by 90 days.

(21) Appl. No.: 17/169,979

(22) Filed: Feb. 8, 2021

(65) Prior Publication Data

US 2022/0250779 A1 Aug. 11, 2022

(51) Int. Cl.
*B65B 31/04* (2006.01)
*B65B 51/10* (2006.01)

(52) U.S. Cl.
CPC ..... *B65B 31/048* (2013.01); *B65B 51/10* (2013.01)

(58) Field of Classification Search
CPC ..... B65B 31/048; B65B 31/04; B65B 31/043; B65B 31/06; B65B 7/02; B65B 7/06; B65B 43/12; B65B 43/123; B65B 43/14; B65B 43/22; B65B 51/10; B65B 51/146; B29C 66/82421
USPC ..... 53/510, 512, 79, 374.8, 374.9, 389.2, 53/389.3
See application file for complete search history.

(56) References Cited

U.S. PATENT DOCUMENTS 4,167,092 A * 9/1979 Medwed ..... B29C 66/81457 53/511
4,735,031 A * 4/1988 Langen ..... B65B 25/067 53/374.8
5,056,292 A * 10/1991 Natterer ..... B29C 65/18 53/373.4
5,088,268 A * 2/1992 Gunter ..... B65B 31/02 53/97
5,105,603 A * 4/1992 Natterer ..... B29C 65/76 53/511
5,386,678 A * 2/1995 Kujubu ..... B65B 31/022 53/512
5,555,704 A * 9/1996 Caufield ..... B65B 55/10 53/503
5,566,531 A * 10/1996 Nordstrom ..... B65B 51/10 53/376.2
5,638,664 A * 6/1997 Levsen ..... B29C 66/8324 53/512
5,682,727 A * 11/1997 Harte ..... B65B 31/024 53/512
6,862,867 B2 * 3/2005 Cady ..... B29C 66/244 53/512

(Continued)

*Primary Examiner* — Dariush Seif

(57) ABSTRACT

The utility model discloses a vacuum sealing machine driven by air pressure. The inner cavity of a seat body is provided with a lifting seat that slides in the vertical direction. A positive air pressure pushing mechanism for driving the lifting seat to move up and down is installed above the lifting seat. A bottom platform is arranged at the lower part of the inner cavity of the seat body. A bag opening heat sealing device is arranged on the bottom surface of the lifting seat or the top surface of the bottom platform. A control circuit is electrically connected to the bag opening heat sealing device. The lifting seat after moving downward when vacuuming or sealing is pressed against the bottom platform. The utility model has the advantages of simple structure, stable and reliable action, and lower cost.

6 Claims, 5 Drawing Sheets

(56) References Cited

U.S. PATENT DOCUMENTS

| | | | | |
|---|---|---|---|---|
| 7,040,074 | B2 * | 5/2006 | Knowlton | B29C 66/43121 383/7 |
| 8,099,931 | B2 * | 1/2012 | Grimm | B65B 61/005 53/511 |
| 9,073,654 | B2 * | 7/2015 | Rothermel | B65B 31/024 |
| 9,550,595 | B2 * | 1/2017 | Steidele | B65B 31/024 |
| 9,994,342 | B2 * | 6/2018 | Furuse | B65B 57/02 |
| 11,084,611 | B2 * | 8/2021 | Thürig | B65B 57/02 |
| 2003/0159405 | A1 * | 8/2003 | Knowlton | B29C 66/82421 53/434 |
| 2004/0139701 | A1 * | 7/2004 | Cady | B29C 66/73715 53/434 |
| 2006/0117711 | A1 * | 6/2006 | Higer | B65B 31/046 53/512 |
| 2014/0165502 | A1 * | 6/2014 | Wah | B29C 66/24245 53/329.2 |
| 2015/0040517 | A1 * | 2/2015 | Furuse | B65B 51/146 53/86 |
| 2017/0326828 | A1 * | 11/2017 | Bonneville | B29C 66/82421 |
| 2018/0022490 | A1 * | 1/2018 | Harrison | B65B 31/00 53/403 |
| 2018/0259092 | A1 * | 9/2018 | McDonald | B29C 66/00145 |

* cited by examiner

VACUUM SEALING MACHINE DRIVEN BY AIR PRESSURE

TECHNICAL FIELD

The utility model relates to the technical field of vacuum sealing machines, in particular to a vacuum sealing machine driven by air pressure.

BACKGROUND ART

The vacuum sealing machine is used to vacuum and perform hot melt sealing on the packaging bag. At present, a mechanical transmission mechanism or a negative pressure drive mechanism drives its upper flip cover to turn toward the base to realize automatic cover locking. Its structure is relatively complex and unstable, and its cost is relatively high, and thus it is necessary to improve.

Content of Utility Model

In view of the shortcomings of the prior art, the purpose of the present utility model is to provide a vacuum sealing machine driven by air pressure with simple structure, stable and reliable action, and low cost.

In order to achieve the above purpose, the technical solution adopted by the present utility model is as follows: A vacuum sealing machine driven by air pressure, comprising a seat body, a control circuit installed in the inner cavity of the seat body, and a vacuuming device which is electrically connected to the control circuit; the inner cavity of the seat body is provided with a lifting seat that slides in the vertical direction, a positive air pressure pushing mechanism for driving the lifting seat to move up and down is installed above the lifting seat, a bottom platform is arranged at the lower part of the inner cavity of the seat body, an air extraction groove is provided on the bottom surface of the lifting seat or the top surface of the bottom platform, the vacuuming device is connected to the air extraction groove, a bag opening heat sealing device is arranged on the bottom surface of the lifting seat or the top surface of the bottom platform, a control circuit is electrically connected to the bag opening heat sealing device, and the lifting seat after moving downward when vacuuming or sealing is pressed against the bottom platform.

Compared with the prior art, the utility model has the advantages of simple structure, stable and reliable action, and lower cost.

DETAILED DESCRIPTION OF EMBODIMENTS

Figure 1:
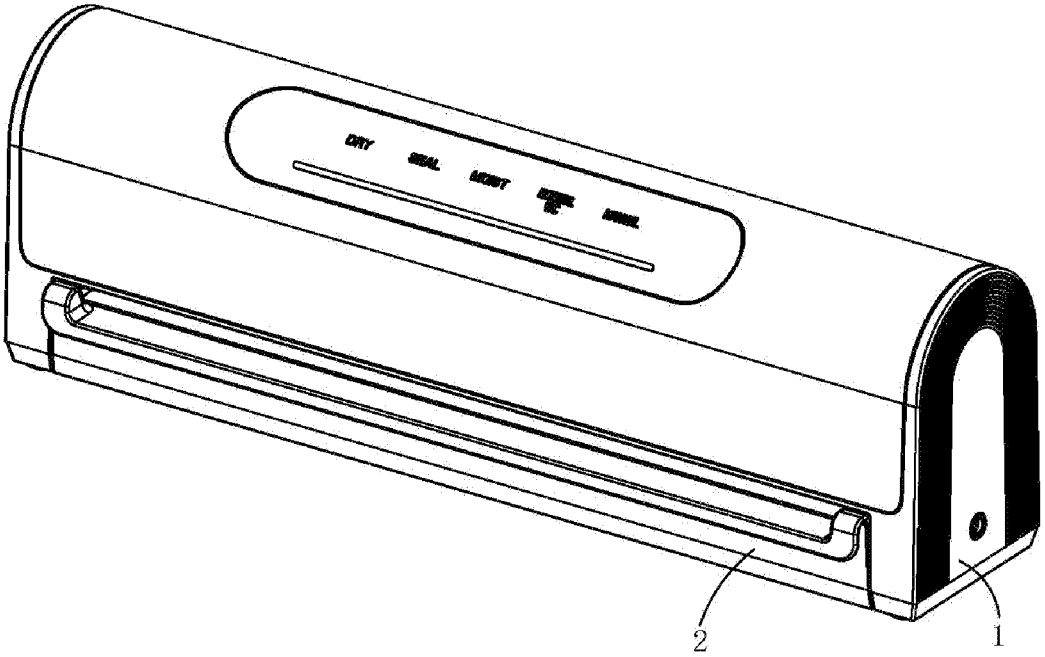
FIG. 1 shows a stereogram of the vacuum sealing machine.
Figure 2:
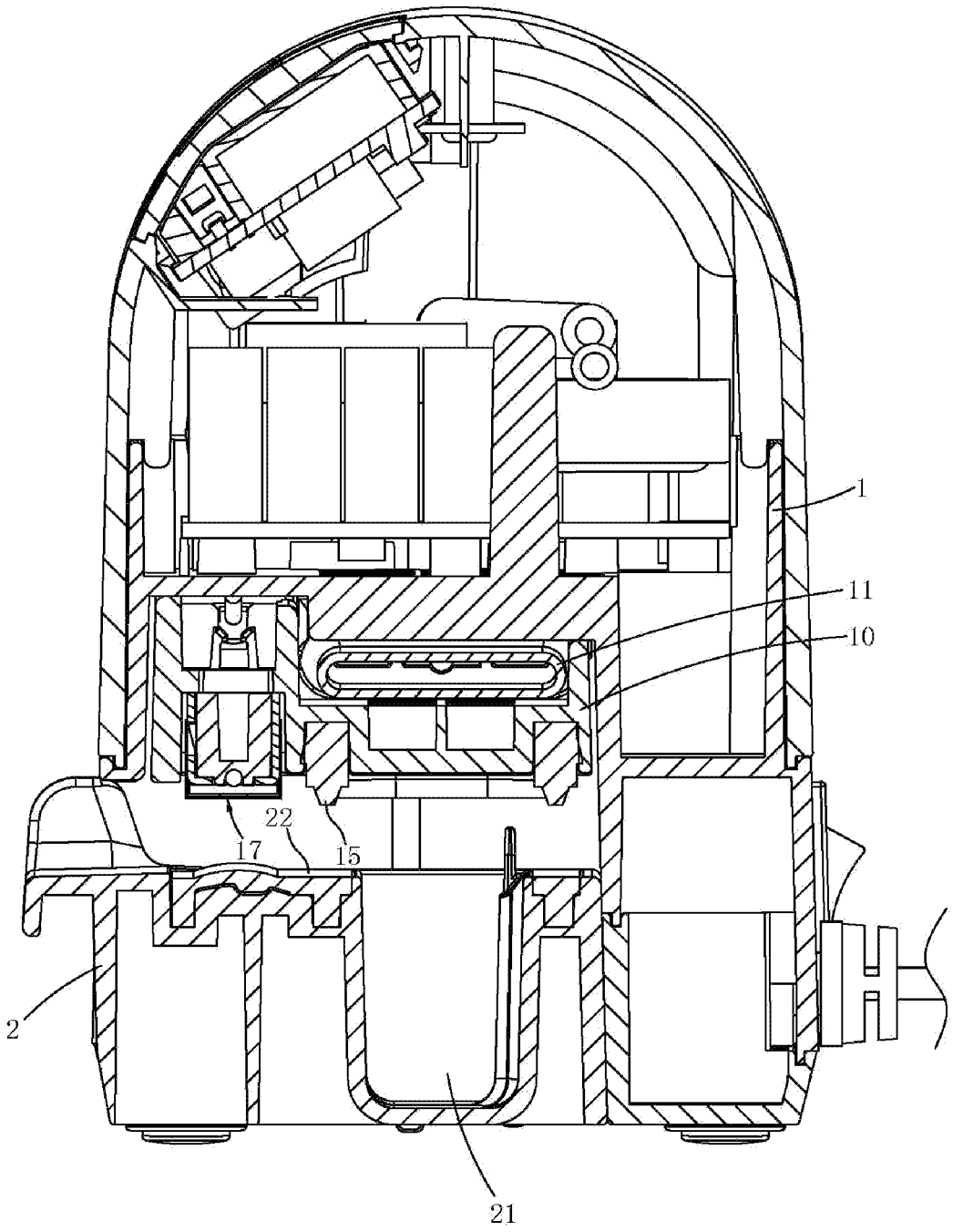
FIG. 2 shows a schematic diagram of the internal structure of the vacuum sealing machine.
Figure 3:
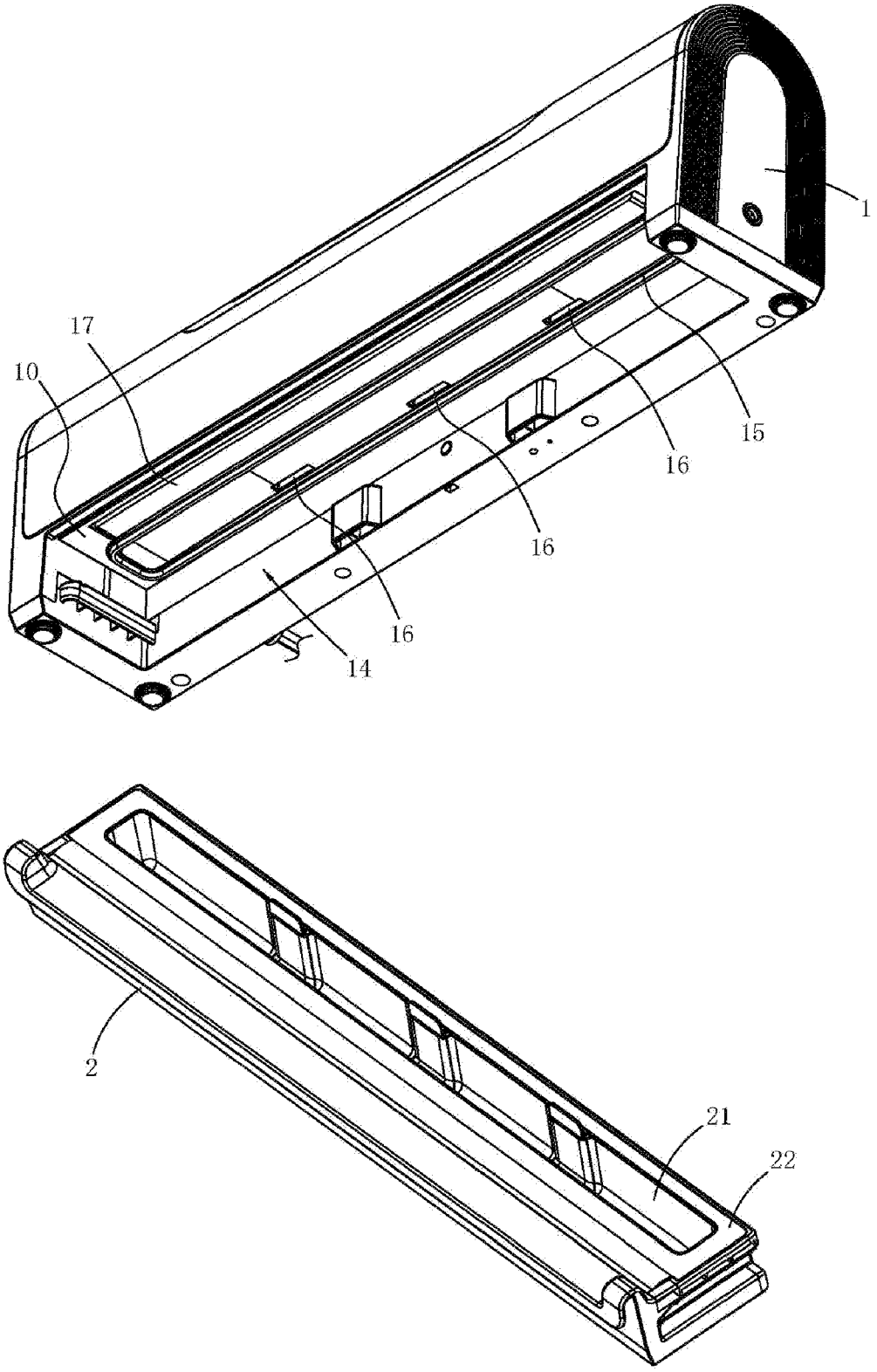
FIG. 3 shows a structure diagram of the bottom platform removed from the storage chamber.
Figure 4:
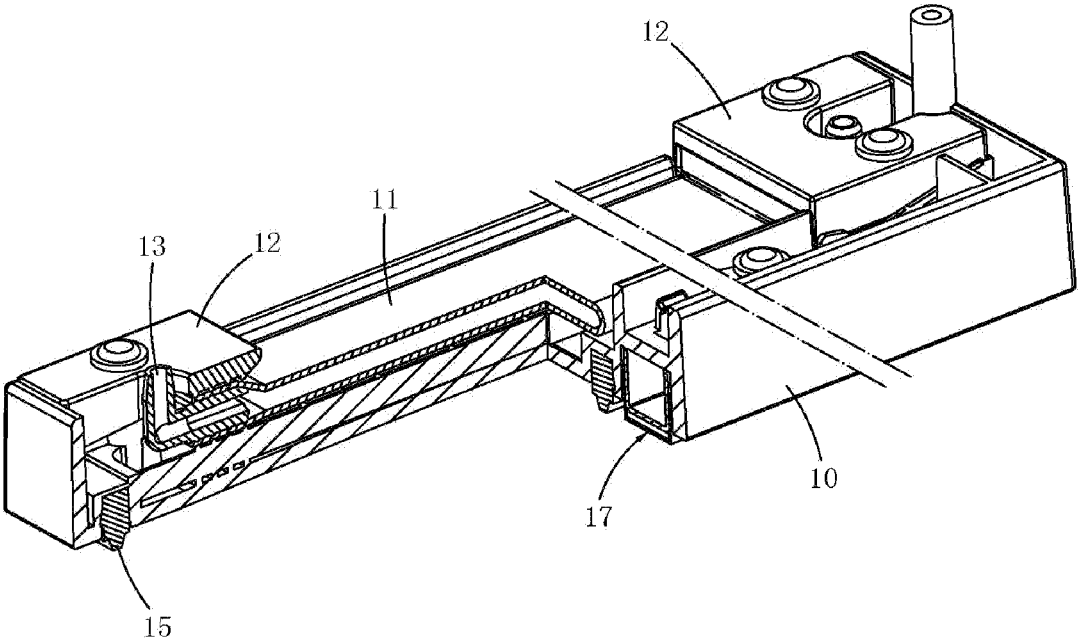
FIG. 4 shows a partial cross-sectional view of the lifting seat.
Figure 5:
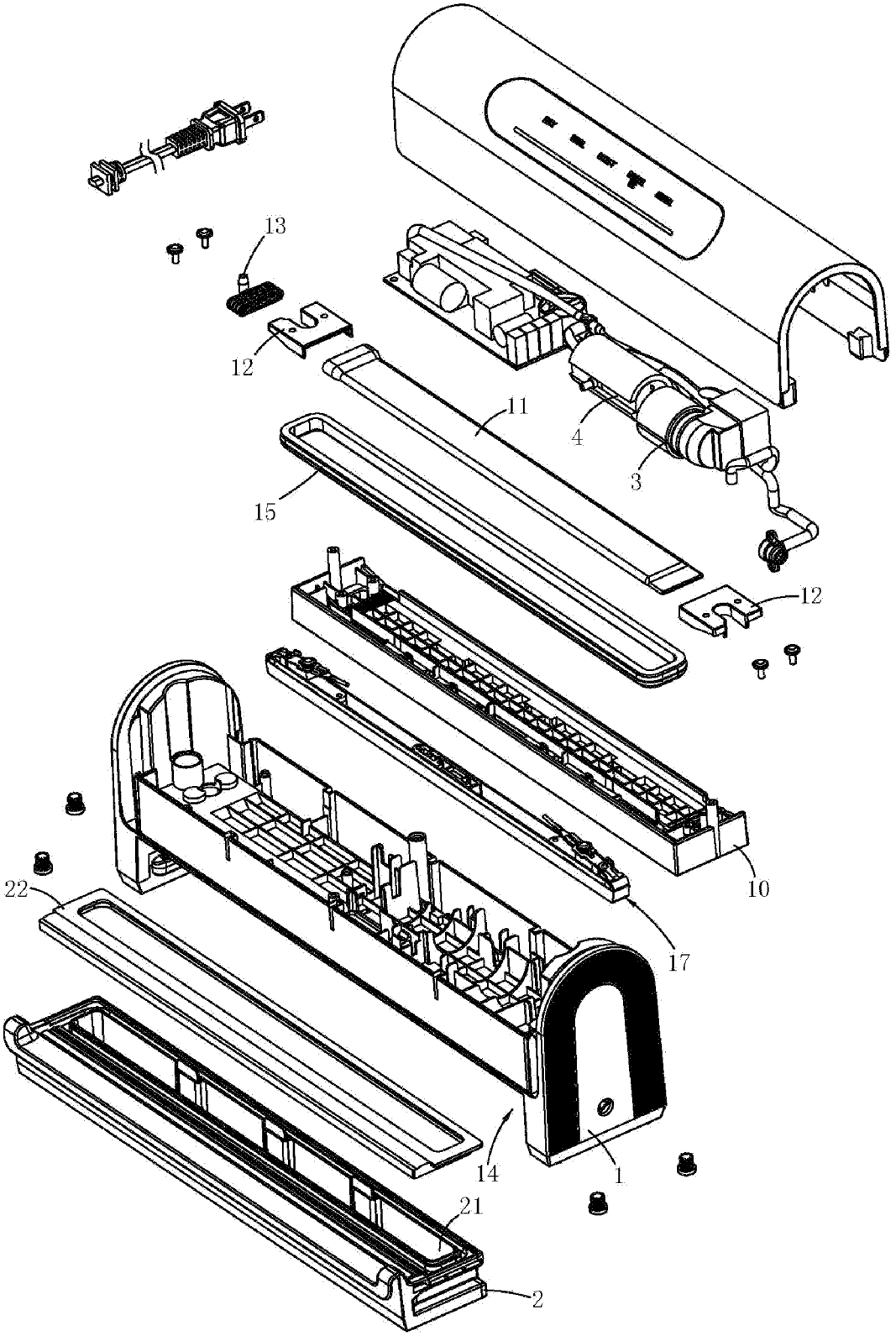
FIG. 5 shows a decomposition diagram of the vacuum sealing machine.

A vacuum sealing machine driven by air pressure, as shown in FIG. 1 to FIG. 5, comprising a seat body 1, a control circuit installed in the inner cavity of the seat body

1, and a vacuuming device which is electrically connected to the control circuit; the upper middle part of the inner cavity of the seat body 1 is slidably installed with a lifting seat 10 that slides in the vertical direction, a positive air pressure pushing mechanism for driving the lifting seat 10 to move up and down is installed above the lifting seat 10, a bottom platform 2 is arranged at the lower part of the inner cavity of the seat body 1, an air extraction groove 21 is provided on the bottom surface of the lifting seat 10 or the top surface of the bottom platform 2, the vacuuming device is connected to the air extraction groove 21, a bag opening heat sealing device 17 is arranged on the bottom surface of the lifting seat 10 or the top surface of the bottom platform 2, and a control circuit is electrically connected to the bag opening heat sealing device 17; the bag opening heat sealing device 17 comprises an insulating base installed at the bottom of the lifting seat 10, a heating sheet fixed on the bottom of the insulating base, and an insulating layer covering the bottom of the heating sheet. The lifting seat 10 after moving downward when vacuuming or sealing is pressed against the bottom platform 2 to press the vacuum packaging bag and perform vacuuming and sealing operations.

The positive air pressure pushing mechanism comprises an air pump 4 installed in the inner cavity of the seat body 1, a positive pressure pipe, and an air bag 11 arranged above the lifting seat 10, the control circuit is electrically connected to the air pump 4, the air pump 4 is connected to the air bag 11 through a positive pressure pipe, and the air bag 11 is fixed on the upper part of the lifting seat 10 or in the inner cavity of the seat body 1, for pushing the lifting seat 10 to move downward. The air bag 11 extends laterally and presses on the top of the lifting seat 10, the left and right ends of the air bag 11 are respectively fixed on the left and right sides of the lifting seat 10, one end is sealed, and the other end is installed with an inflation interface 13, a return spring is installed on the seat body 1 or the lifting seat 10, and the lifting seat 10 is pushed up to move and reset by the return spring after the pressure is released.

The air bag 11 comprises a hollow, flat-shaped elastic bag that expands after being inflated inside; the left and right sides of the top of the lifting seat 10 are respectively fixed with a pressure cover 12, the two pressure covers 12 are respectively crimped and fixed to the left and right ends of the elastic bag body, one end of the elastic bag body is sealed and plugged into an inflation interface 13, and a positive pressure pipe is connected to the inflation interface 13. One end of the inflation interface 13 is provided with a flat-shaped plug-in portion, and the other end is provided with a pipe interface, the surface of the plug-in portion is formed with a plurality of convex rings arranged at intervals to increase the connection firmness and airtightness, the plug-in portion is inserted tightly at one end of the elastic bag body, a vent hole is opened in the middle of the plug-in portion, and the vent hole communicates with the pipe interface; the positive pressure pipe is connected with an electric pressure relief valve or a pressure relief component, and the control circuit is electrically connected with the electric pressure relief valve or the pressure relief component. When the air pump 4 is working, the air pressure is pumped into the elastic bag body, so that the elastic bag body expands and becomes larger, thereby generating thrust and pushing the lifting seat 10 to move downward.

The seat body 1 comprises a shell, the lower part of the shell is provided with a storage chamber 14, the front side and the bottom side of the storage chamber 14 respectively penetrate the shell to form a bottom platform entrance, the bottom platform 2 is movably inserted into the storage chamber 14 through the bottom platform entrance, the left and right sides of the storage chamber 14 are respectively provided with a slide rail, the left and right sides of the bottom platform 2 are respectively provided with a sliding groove for the slide rails that are sleeved on the corresponding side, the outer side of the bottom platform 2 is provided with a handle or a curling edge, the bottom platform 2 is formed with a plurality of laterally spaced limit baffles, the upper part of the limit baffle protrudes from the top surface of the bottom platform 2, the limit baffle is located on the front side of the rear side wall of the air extraction groove 21, and the bottom platform 2 can be removed for cleaning; the bottom surface of the lifting seat 10 is exposed on the top surface of the storage chamber 14, the bottom of the lifting seat 10 is fixed with a bag opening heat sealing device 17 and a hollow sealing strip 15 in the middle area, the bag opening heat sealing device 17 and the sealing strip 15 are respectively protrudingly arranged on the bottom surface of the lifting seat 10, and the bag opening heat sealing device 17 is arranged opposite to the front side of the sealing strip 15; and a plurality of air extraction ports 16 are provided on the bottom surface of the lifting seat 10, and each air extraction port 16 is provided in the inner area of the sealing strip 15. The vacuuming device comprises an air extraction pump 3, the air extraction pump 3 is provided with an air extraction interface, the control circuit is electrically connected to the air extraction pump 3, the lifting seat 10 is provided with an air extraction channel, the air extraction interface is connected to the air extraction channel, and the air extraction channel is connected to each air extraction port 16.

The top surface of the bottom platform 2 is provided with an air extraction groove 21, a rubber pad 22 is installed on the top surface of the bottom platform 2, the rear side of the rubber pad 22 is provided with a transversely extending hollow groove and a sealing fitting portion is formed on the outer edge of the hollow groove, the front side of the rubber pad 22 is integrally formed with a sealing bead protruding relative to the sealing fitting portion, and the sealing fitting portion and the sealing bead are connected as a whole; the sealing strip 15 corresponding to the outer edge area of the air extraction groove 21 is installed at the bottom of the lifting seat 10; at least when vacuuming, the sealing strip 15 is in a sealed fit with the sealing fitting portion to realize the vacuuming operation; and at least when sealing, the bag opening heat sealing device 17 is press-fitted with the sealing bead to realize the hot melt sealing operation.

The invention claimed is:

1. A vacuum sealing machine driven by air pressure, comprising a seat body (1), a control circuit installed in an inner cavity of the seat body (1), and a vacuuming device which is electrically connected to the control circuit, wherein: The inner cavity of the seat body (1) is provided with a lifting seat (10) that slides in the vertical direction, a positive air pressure pushing mechanism for driving the lifting seat (10) to move up and down is installed above the lifting seat (10), a bottom platform (2) is arranged at the lower part of the inner cavity of the seat body (1), an air extraction groove (21) is provided on the bottom surface of the lifting seat (10) or the top surface of the bottom platform (2), the vacuuming device is connected to the air extraction groove (21), a bag opening heat sealing device (17) is arranged on the bottom surface of the lifting seat (10) or the top surface of the bottom platform (2), a control circuit is electrically connected to the bag opening heat sealing device (17), and the lifting seat (10) after moving downward when vacuuming or sealing is pressed against the bottom platform (2);

wherein the positive air pressure pushing mechanism comprises an air pump (4) installed in the inner cavity of the seat body (1), a positive pressure pipe, and an air bag (11) arranged above the lifting seat (10) for pushing the lifting seat (10) to move downward, the control circuit is electrically connected to the air pump (4), the air pump (4) is connected to the air bag (11) through the positive pressure pipe, and the air bag (11) is fixed on the upper part of the lifting seat (10) or in the inner cavity of the seat body (1);

wherein the air bag (11) extends laterally and presses on the top of the lifting seat (10), the left and right ends of the air bag (11) are respectively fixed on the left and right sides of the lifting seat (10), one end is sealed, and the other end is installed with an inflation interface (13), and a return spring for pushing the lifting seat (10) to move upward is installed on the seat body (1) or the lifting seat (10);

wherein the air bag (11) comprises a hollow, flat-shaped elastic bag that expands after being inflated inside; and the left and right sides of the top of the lifting seat (10) are respectively fixed with a pressure cover (12), the two pressure covers (12) are respectively crimped and fixed to the left and right ends of the elastic bag body, one end of the elastic bag body is sealed and plugged into the inflation interface (13), and the positive pressure pipe is connected to the inflation interface (13).

2. The vacuum sealing machine driven by air pressure according to claim 1, wherein one end of the inflation interface (13) is provided with a flat-shaped plug-in portion, and the other end is provided with a pipe interface, the surface of the plug-in portion is formed with a plurality of convex rings arranged at intervals, the plug-in portion is inserted tightly at one end of the elastic bag body, a vent hole is opened in the middle of the plug-in portion, and the vent hole communicates with the pipe interface; the positive pressure pipe is connected with an electric pressure relief valve or a pressure relief component, and the control circuit is electrically connected with the electric pressure relief valve or the pressure relief component.

3. The vacuum sealing machine driven by air pressure according to claim 2, wherein the seat body (1) comprises a shell, the lower part of the shell is provided with a storage chamber (14), the front side and/or the bottom side of the storage chamber (14) penetrate(s) the shell to form a bottom platform entrance, and the bottom platform (2) is movably inserted into the storage chamber (14) through the bottom platform entrance;

the bottom surface of the lifting seat (10) is exposed on the top surface of the storage chamber (14), the bottom of the lifting seat (10) is fixed with the bag opening heat sealing device (17) and a hollow sealing strip (15) in the middle area, the bag opening heat sealing device (17) and the sealing strip (15) are respectively protrudingly arranged on the bottom surface of the lifting seat (10), and the bag opening heat sealing device (17) is arranged opposite to the front side of the sealing strip (15); and at least one air extraction port (16) is provided on the bottom surface of the lifting seat (10), and the air extraction port (16) is provided in the inner area of the sealing strip (15).

4. The vacuum sealing machine driven by air pressure according to claim 3, wherein the top surface of the bottom platform (2) is provided with the air extraction groove (21), a rubber pad (22) is installed on the top surface of the bottom platform (2), the rear side of the rubber pad (22) is provided with a transversely extending hollow groove and a sealing fitting portion is formed on the outer edge of the hollow groove, and the front side of the rubber pad (22) is integrally formed with a sealing bead protruding relative to the sealing fitting portion;

the sealing strip (15) corresponding to the outer edge area of the air extraction groove (21) is installed at the bottom of the lifting seat (10);

at least when vacuuming, the sealing strip (15) is in a sealed fit with the sealing fitting portion; and at least when sealing, the bag opening heat sealing device (17) is press-fitted with the sealing bead.

5. The vacuum sealing machine driven by air pressure according to claim 4, wherein the vacuuming device comprises an air extraction pump (3) with an air extraction interface, the control circuit is electrically connected to the air extraction pump (3), and the air extraction interface is connected to the air extraction port (16); the bag opening heat sealing device (17) comprises an insulating base installed at the bottom of the lifting seat (10), a heating sheet fixed on the bottom of the insulating base, and an insulating layer covering the bottom of the heating sheet.

6. The vacuum sealing machine driven by air pressure according to claim 4, wherein the left and right sides of the storage chamber (14) are respectively provided with a slide rail, the left and right sides of the bottom platform (2) are respectively provided with a sliding groove for the slide rails that are sleeved on the corresponding side, the outer side of the bottom platform (2) is provided with a handle or a curling edge, the bottom platform (2) is formed with a plurality of laterally spaced limit baffles, the upper part of the limit baffle protrudes from the top surface of the bottom platform (2), and the limit baffle is located on the front side of the rear side wall of the air extraction groove (21).

* * * * *